United States Patent [19]

Nakaoka et al.

[11] 4,052,235

[45] Oct. 4, 1977

[54] METHOD OF PREVENTING OXIDATION DURING WATER QUENCHING OF STEEL STRIP

[75] Inventors: Kazuhide Nakaoka; Kenji Araki; Yoshikazu Takada, all of Yokohama; Shinobu Osaka; Katsuhiko Hirogami, both of Fukuyama, all of Japan

[73] Assignee: Nippon Kokan Kabushiki Kaisha, Tokyo, Japan

[21] Appl. No.: 617,578

[22] Filed: Sept. 29, 1975

[30] Foreign Application Priority Data

Dec. 24, 1974 Japan ..... 49-147548

[51] Int. Cl.[2] ..... C21D 9/52

[52] U.S. Cl. ..... 148/156; 148/157

[58] Field of Search ..... 148/153, 156, 157, 155

[56] References Cited

U.S. PATENT DOCUMENTS 3,410,734 11/1968 Taylor ..... 148/153

*Primary Examiner*—R. Dean

*Attorney, Agent, or Firm*—Haseltine, Lake & Waters

[57] ABSTRACT

In a continuous annealing operation of a cold rolled steel strip involving water quenching and over-aging treatments, a method employing a cooling system comprising a pair of rolls arranged to contact the surfaces of a steel strip, a pair of cooling water spray units arranged in symmetrical positions on both sides of the steel strip and a storage tank connected to the spray units. When the steel strip, heated to a temperature between 500° to 800° C is water quenched, the distortion of the strip during the water quenching is inhibited and the surface oxidation is reduced to such an extent that no supplementary pickling is required.

3 Claims, 10 Drawing Figures

METHOD OF PREVENTING OXIDATION DURING WATER QUENCHING OF STEEL STRIP

BACKGROUND OF THE INVENTION

The present invention relates to improvements for eliminating the disadvantages of conventional continuous annealing processes of cold rolled strips including water quenching and over-aging treatments, such as the oxidation of the surface of the steel strip during the water quenching and hence the necessity of pickling the steel strip to remove the resulting oxide film on surface.

In a known type of continuous annealing line for cold rolled steel strip involving water quenching and over-aging treatments, a steel strip which has been heated to a temperature between 500° to 800° C through a heating furnance and a soaking pit is quenched in a spray of water, immersed in a pickling tank to remove the oxide film from the surface, and then subjected to an over-aging treatment in a shelf treating furnance.

Several different methods and apparatus have been proposed in which a steel strip is rapidly cooled from an elevated temperature by spraying cooling water against the steel strip. While some of these methods and apparatus take into consideration the flow conditions of water such as laminar flow or turbulent flow, the purpose of this is in all cases to ensure an improved heat transfer coefficient and none of these conventional methods and apparatus take into consideration the flow conditions of cooling water with a view to reducing the amount of surface oxidation of steel strip during the water quenching.

Further, while a method and an apparatus have been proposed by a group of persons including the inventors, in which a steel strip heated to a temperature between 700° to 800° C is quenched without any distortion, in the actual application the surface of the quenched steel strip is oxidized, thus requiring a pickling operation for removing the resulting oxide film from the surface, though there is no occurrence of distortion.

SUMMARY OF THE INVENTION

An object of the present invention is to provide an improved method for water quenching a steel strip from an elevated temperature, in which the oxidation of the steel strip during the water quenching operation is reduced to such an extent that no supplementary pickling operation is required for the removal of the resulting oxide film.

Another object of the present invention is to provide a method in which a steel strip is rapidly cooled from an elevated temperature by directing sprays of uniform cooling water with a spray impact pressure between 40 to 170 mmHg against each surface of the steel strip.

BRIEF DESCRIPTION OF THE DRAWINGS

The inventive method will now be explained in a detailed description, with reference to the accompanying drawings, wherein:

FIG. 2(*b*) is a photograph of a steel strip water quenched by a water quenching method of this invention.

DETAILED DESCRIPTION OF THE INVENTION

Figure 1:
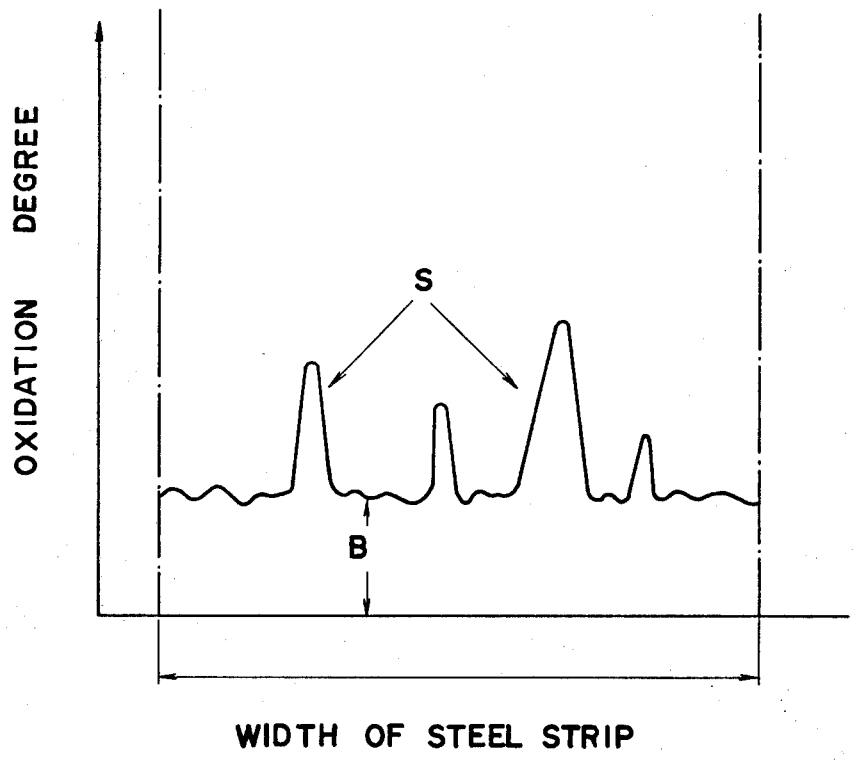
FIG. 1 PRIOR ART
FIG. 1 is a graph showing the distribution of oxide layer along the width of a steel strip which is produced when the steel strip was water quenched by a conventional water quenching method.

FIG. 1 shows the amount of oxidation in a steel strip after conventional quenching in a spray of water, and it will be seen from FIG. 1 that the oxide layer formed on the surface of the steel strip which was continuously water quenched in the reducing atmosphere may be roughly divided into two portions. Namely, one portion is an oxide film practically uniformly formed over the entire surface of the strip, and this may be considered to constitute a background oxide B. The other is more heavily oxidized, scattered over the surface of the strip (hereinafter referred to as spatters S). The photograph of FIG. 2(*a*) shows the amount of oxidation of the steel strip actually conventionally quenched.

Although the process of oxidation of the water quenched steel strip has not been made clear to the satisfactory extent, the following four causes may be presumed in qualitative consideration of the above-mentioned oxidation state:

i. Vapor oxidation due to the formation of vapor blanket or film.
ii. Oxidation caused by gas bubbles contained in cooling water.
iii. Oxidation caused by the clinging of a splash of cooling water to a heated steel strip before water quenching.
iv. Oxidation due to the mixing an atmosphere gas with sprays of cooling water.

The investigation made by the inventors into measures to counter the above-mentioned four causes showed the following.

Firstly, the study on the vapor oxidation due to the formation of vapor film showed that when a steel strip heated to a temperature higher than the Leidenfrost temperature was quenched in water, the water in the vicinity of the steel strip was evaporated so that the heat was transferred under the state of so-called film boiling. The temperature of the steel strip placed in this condition dropped very slowly and the steel strip was maintained at the elevated temperature, thus causing a reaction between the vapor and the steel strip, which resulted in a vapor oxidation.

It was then found that such vapor oxidation could be prevented by preventing the formation of vapor or by removing a vapor film as soon as it was formed. To ascertain this discovery, a comparison was made between the cases where steel strips heated to high temperatures in an atmosphere of $H_2 + N_2$ reducing gas were quenched in static water, and the cases where such steel strips were quenched in a sprayed water with different spray impact pressures.

Figure 3:
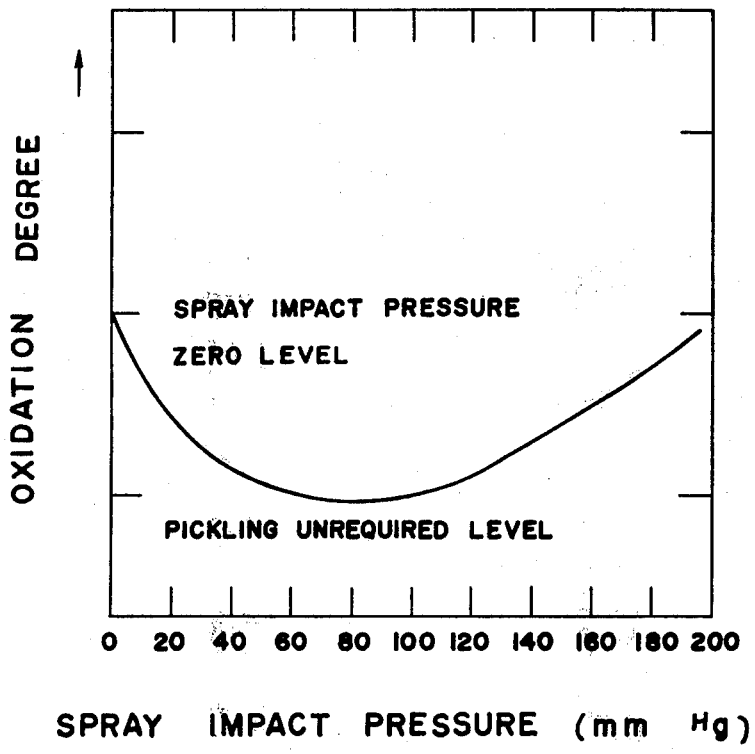
FIG. 3 is a graph showing the relationship between the spray impact pressure and the amount of oxidation produced when a steel strip heated to an elevated temperature in an atmosphere of $H_2 + N_2$ reducing gas was quenched in a spray of water.

The results of the comparison showed that the amount of oxidation was apparently smaller when the steel strip was quenched in sprayed water than otherwise as shown in FIG. 3. As will be seen from FIG. 3, the amount of surface oxidation of quenched steel strips can be reduced by quenching the steel strip in sprayed water and using a higher water pressure than the vapor pressure to inhibit the formation of vapor film, or by removing such vapor film as soon as it is formed.

On the other hand, when the matter is confined to the background oxide film, it was found that the dynamic pressure of a spray of water just prior to its impingement against the surface of a steel strip (hereinafter referred to as a spray impact pressure) should be as high as possible both in terms of inhibiting the occurrence of vapor film or removing the vapor film, and it was found by experiments that spray impact pressures higher than 10 mmHg could be used effectively.

Further, the study of the oxidation of steel strips by gaseous bubbles contained in cooling water showed that since the cooling water was used repeatedly by recirculating it, the cooling water generally contained air bubbles or bubbles of other gaseous constituents. The results of experiments conducted by blowing $N_2$ gas into the cooling water to investigate the effects of such bubbles showed that the surface oxidation state of the steel strips deteriorated considerably and particularly the amount of spatters increased considerably.

Figure 4:
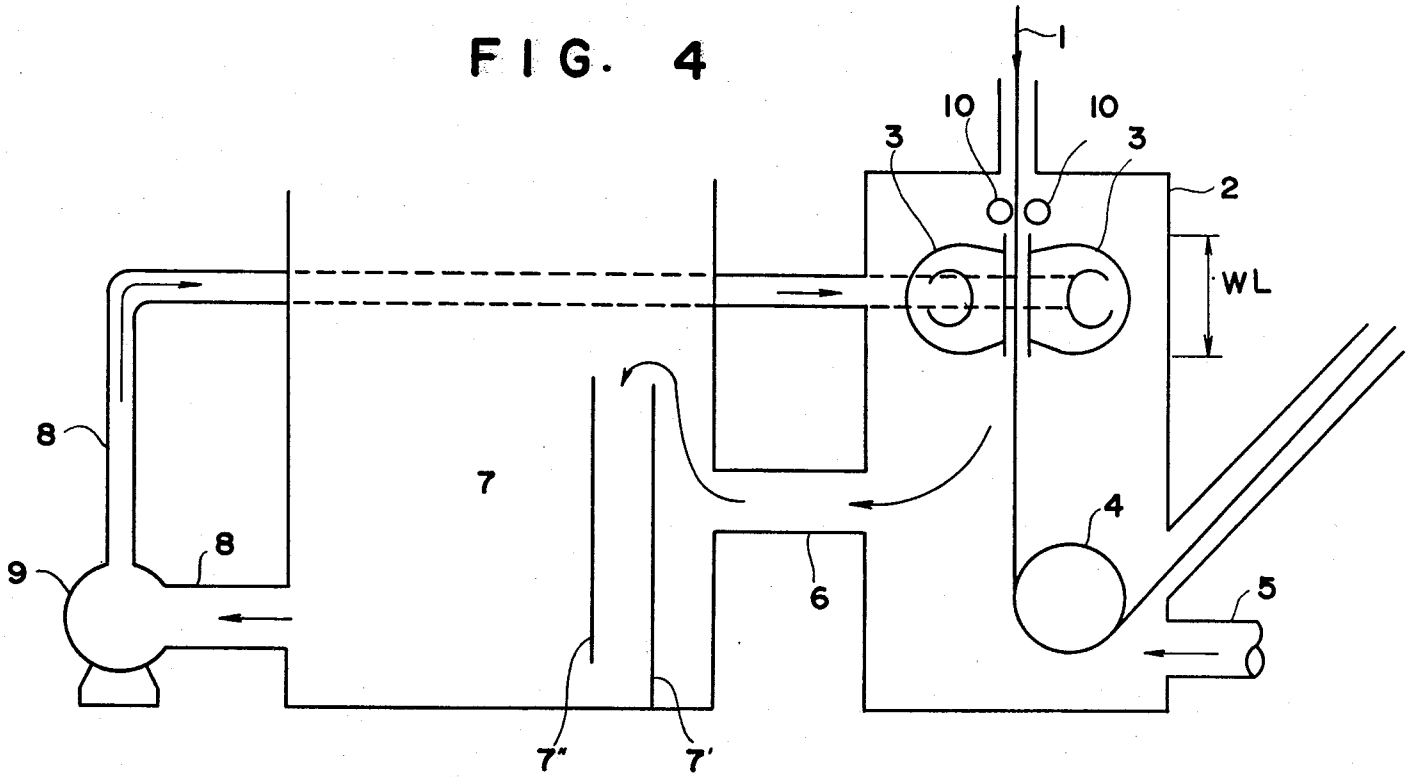
FIG. 4 is a schematic diagram showing the general construction of an exemplory apparatus suitable to perform the method according to the invention.

While the mechanism of the oxidation caused by the bubbles in cooling water has not been made clear as yet, it is evident that the presence of gases in cooling water adversely affects the surface oxidation of steel strips. While there are various methods available for removing the gaseous bubbles from cooling water or preventing the entry of bubbles into the cooling water, a water storage tank may be advantageously provided to float the bubbles, as shown in FIG. 4. The capacity of the storage tank must be selected so that the cooling water is retained in the tank for more than 5 minutes before it is circulated for reuse.

On the other hand, the investigation into the amount of oxidation caused by the clinging of a splash of cooling water to a heated steel strip before its quenching showed that in FIG. 3, while the amount of oxidation in the steel strip initially decreased as the spray impact pressure increased, further increase in the spray impact pressure above 100 mmHg resulted in increased spatters, thus aggravating the oxidation state of the steel strip. This was due to the fact that the amplitude of the surface wave of the spray increased as the spray impact pressure increased, with the result that the surface tension was eventually overcome, causing the water to splash; the scattered water caused the formaton of spatters, thus aggravating the oxidation state of the steel strip.

To prevent the oxidation of the steel strip by the splashed water, it is necessary to reduce the spray impact pressure and take into consideration the direction of injection from the slit or slits in the uppermost portion of a spray unit. More specifically, it is necessary to reduce the spray impact pressure below 80 mmHg and arrange the uppermost slit to make a declination with the direction of travel of the steel strip.

However, decreasing the spray impact pressure contradicts with the above-mentioned counter-measures for preventing the formation of vapor film. These contradictory requirements may be made compatible with each other by producing a uniform water spray. While the relationship between the amount of oxidation and the spray impact pressure of uniform cooling water sprays is shown in FIG. 5, the required uniform flow is accomplished by means of a cooling system which will be described later.

Figure 5:
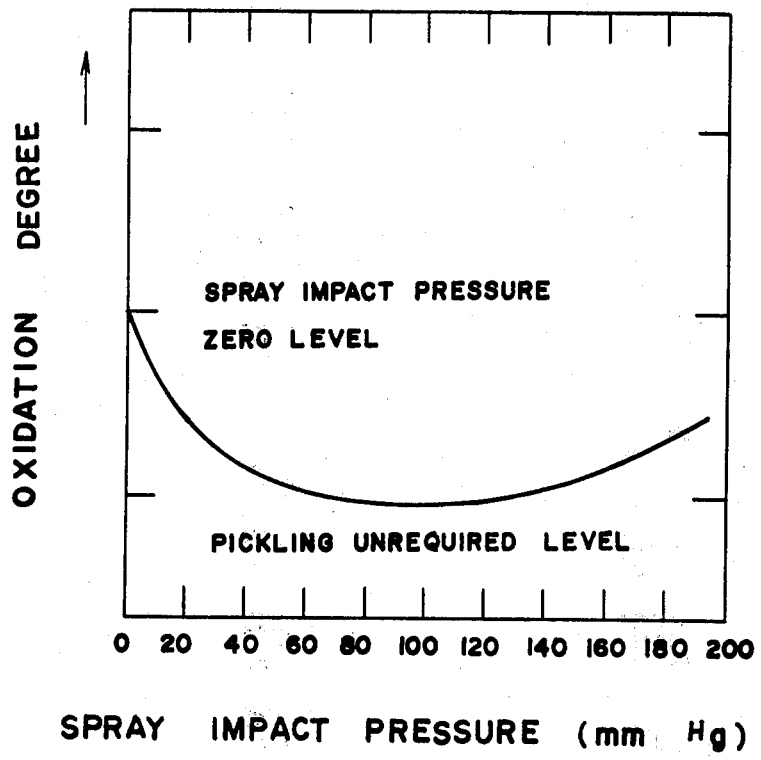
FIG. 5 is a graph showing the relationship between the spray impact pressure and the amount of oxidation when a uniform-flow spray was employed.

As will be seen from FIG. 5, the spray of uniform flow results in an increased range of proper spray impact pressures, and the spray impact pressures in the range between 80 and 140 mmHg may be advantageously used for quenching steel strips with a reduced amount of spatters.

Lastly, the investigation into the effects of the mixed atmosphere gases on the amount of oxidation in the steel strips showed that, as shown in FIG. 3, as the spray impact pressure was increased, the amount of spatters increased, and at the same time the background increased, thus changing the oxidation figure. To ascertain the cause of the oxidation by the mixed atmosphere gas, a series of tests were conducted in which cooling water was sprayed against a transparent acrylic resin sheet. It was found by these tests that the atmosphere gas was mixed in the spray of cooling water when the latter impinging on the steel strip, and a mixture of the atmosphere gas and the water impinged on the steel strip, thus increasing the background oxide. As a means for preventing this mixing of the atmosphere gas, cooling water sprays from the spray unit may be made uniform to reduce the turbulence of the sprays, and the distance between the water sprays may be increased to reduce the interaction between the individual cooling water sprays impinging on the steel strip.

The present invention has been made on the basis of the above-mentioned discovery, and it relates to a method whereby in the continuous manufacture of mild steel strip by shelf treating, cooling water is sprayed against the surfaces of steel strip in form of multistage two-dimentional water sprays arranged in the direction of travel of the steel strip, and the steel strip heated to a temperature between 500° to 800° C is cooled to below 500° C with the result of a reduced amount of surface oxidation and without any detrimental effect on the properties of the steel strip.

The method according to the invention will be described in greater detail with reference to the illustrated exemplory apparatus embodiments in which is treated a strip of mild steel having a carbon content of less than 0.08% (by weight) and having a thickness of 0.06 to 1.60 mm and a width of 600 to 1800 mm. The speed of a continuous annealing line is generally between 60 to 300 m/min.

Referring now to FIG. 4, numeral 1 designates a steel strip which is fed from a heating furnace and a soaking pit (not shown) vertically into a cooling tank 2 toward a sink roll 4 provided in the lower portion of the cooling tank 2 and strip is, after cooling, delivered to a overaging furnace. Numeral 10 designates a pair of rolls arranged in the upper portion of the cooling tank 2 to contact the surfaces of the steel strip 1. A pair of cooling water spray units 3 are arranged in symmetrical positions on both sides of the steel strip below the rolls 10.

Numeral 5 designates a cooling water supply pipe for feeding fresh water to the cooling tank 2, 6 is a drain pipe communicating the cooling tank 2 with a water storage tank 7 located adjacent to the cooling tank 2. Numeral 7' designates a water level regulating weir provided in the water storage tank 7 on the drain pipe 6 side, 7'' a partition plate provided near the weir 7'. Numeral 8 designates a duct provided near the bottom of the water storage tank 7 on the side opposite to the drain pipe 6 to feed the cooling water, pressurized by a pump 9, to the cooling water spray units 3. The retention time of the cooling water in the water storage tank 7 should preferably be longer than 5 minutes. The water level in the cooling tank 2 may be adjusted by means of the water level regulating weir 7' within the limits indicated at WL.

Figure 6:
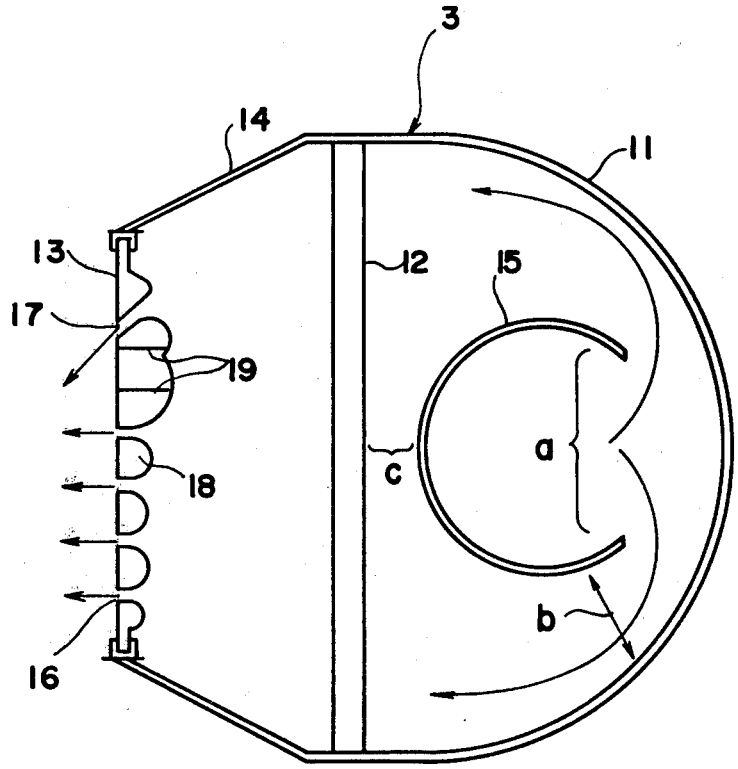
FIG. 6 is an enlarged schematic view showing the construction of the cooling water spray unit used in the exemplory apparatus.

Referring now to FIG. 6 illustrating an enlarged detail sectional view of the cooling water spray unit 3, numeral 11 designates a rear wall having a semicircular cross section, 12 a damping screen such as a honeycomb or wire netting provided in the central portion of the spray unti 3, 13 is a nozzle plate formed with a plurality of slits 16 and 17, 14 is a front wall having a reducing taper toward the front of the unit in which the nozzle plate 13 is fixedly mounted. Numeral 15 designates a water supply pipe having a C-shaped cross section and open at a position opposite to the rear wall 11. The numeral 17 designates one of the plurality of slits which is downwardly opened to make a declination with the direction of travel of the steel strip and which is distinguished from the other slits 16 that open normal to the direction of travel of the steel strip or parallel to each other.

Figure 7A:
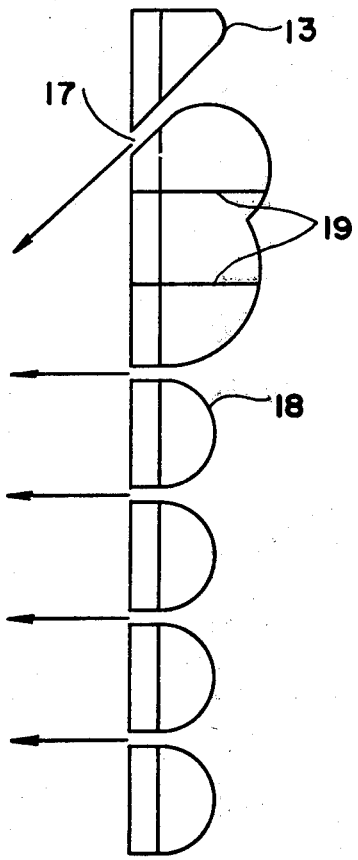
FIGS. 7(*a*) and 7(*b*) are sectional views showing different embodiments of the nozzle plate used in the cooling water spray unit of FIG. 6.
Figure 7B:
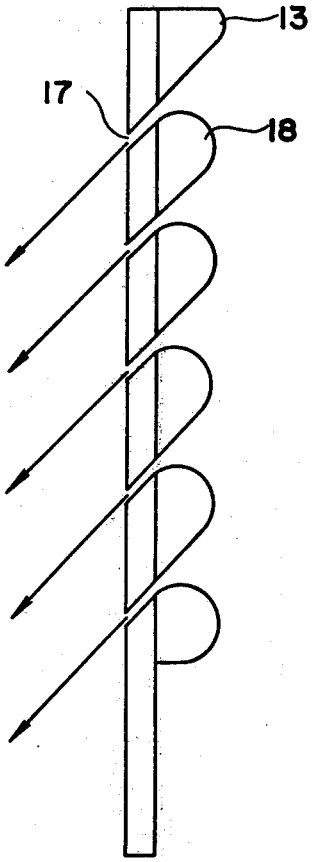

While all of the slits to open downwardly as shown in FIG. 7(*b*), or a plurality of the slits in the uppermost part of the nozzle plate 13 may open downwardly, the uppermost one of the slits may be opened open downwardly as shown in FIG. 7(*a*) to suppress a splash of water.

Numeral 18 designates a reinforcing plate secured to the back of the nozzle plate 13 and having a curved rear surface producing uniform water flow. Numeral 19 designates closed slits for ensuring the same amount of bending in all the parts of the nozzle plate 13 when it is bent by the water pressure. The number and positions of the slits 19 are selected to ensure the same moment of inertia of the area.

The cooling water spray unit 3 shown in FIG. 6 is designed to provide multistage two-dimentional uniform sprays in directions normal to that in which the water is fed from the water supply pipe 15, and the diameter of the water supply pipe 15 must be selected 1/10 to ¾ of that of the rear wall 11.

The honey-comb or wire netting 12 is provided for the purpose of eliminating the momentum of the cooling water in directions other than the spouting directions thereof, and the momentum is converged by the provision of a distance (C) between the honey-comb or wire netting 12 and the water supply pipe 15.

It should also be apparent that the angle of opening (*a*) of the water supply pipe 15 must be smaller than 180°, and if a distance (*b*) between the open end of the water supply pipe 15 and the rear wall 11 is selected too small, the flow rate of the cooling water increases, thus disturbing the spraying of the cooling water, whereas if the distance (*b*) is selected excessively large, the mechanism of producing a uniform flow does not work, thus disturbing the sprays.

The purpose of the rolls 10 is to prevent the cambering of the steel strip due to its thermal shrinkage. The rolls 10 must be positioned so that they are arranged within a distance of 1,000 mm from the associated uppermost slits 17 in the nozzle plates 13. The distance between the rolls 10 is selected to provide a roll face gap smaller than the distance between the opposed cooling water spray units 3.

Figure 2A:
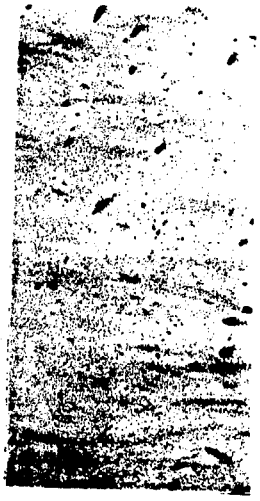
FIG. 2a PRIOR ART
FIG. 2(*a*) is a photograph of the steel strip water quenched by the conventional method.
Figure 2B:
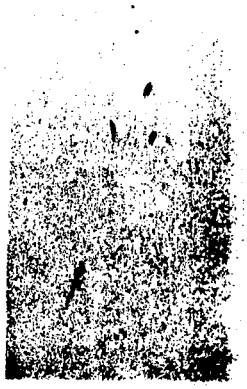
Figure 8:
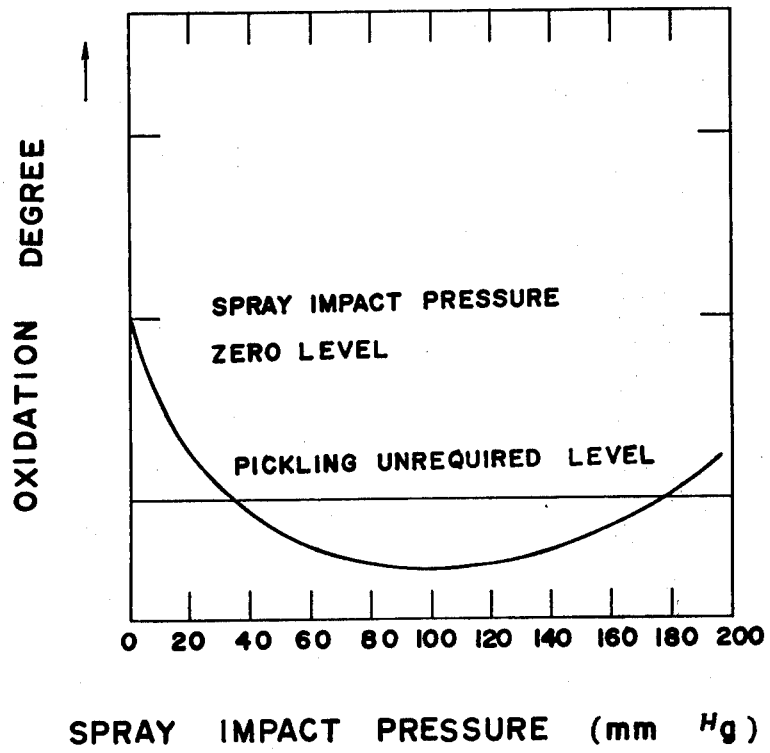
FIG. 8 is a graph showing the relationship between the spray impact pressure and the amount of oxidation in the steel strip quenched by the water quenching method of this invention, with the curves shown in FIGS. 3, 5 and 8 obtained from the times required for pickling operation.

FIG. 8 shows the relationship between the amount of oxidation and the spray impact pressure obtained when steel strips of the same grade and dimensions as used in the above-described embodiment were water quenched by the method of this invention described in connection with FIGS. 4 and 6. As will be seen from FIG. 8, by quenching a steel strip with a spray impact pressure between 40 to 170 mmHg, it is possible to reduce the amount of surface oxidation in the strip steel only be means of a reduction due to the reducing gas of an over-aging furnace, and therefore it is possible to obtain the quenched steel strip having a very small amount of oxidation as shown in FIG. 2(*b*). The camber of the steel strip which is expected to increase due to a spray of uniform water flow is prevented by the action of the rolls 10, thus completely eliminating the possibility of the steel strip coming into contact with the nozzle plates 13.

Several widely different embodiments of this invention may be made without departing from the spirit and scope thereof.

What is claimed is:

1. A method of reducing oxidation during water quenching as part of continuous annealing of a cold-rolled steel strip, comprising the steps of quenching the steel strip from an elevated temperature between 500° to 800° C by rapidly cooling said strip by directing uniform flow cooling water sprays against each surface of said steel strip with a spray impact pressure between 40 to 170 mm Hg from a pair of symmetrical cooling-water spray units to restrain the generation of water vapor, and to thereby reduce the amount of oxidation of the strip during the water quenching to such an extent that no supplementary pickling operation is required and then subjecting said steel strip to reducing gas over-aging treatment in a shelf treating furnace.

2. The oxidation reducing method as defined in claim 1, wherein the linear speed for the continuous annealing is between 60 to 300 m/min.

3. The oxidation reducing method as defined in claim 1, further comprising the step of removing gas bubbles from the cooling water prior to reuse.

* * * * *